United States Patent [19]

Ferch

[11] 4,140,330

[45] Feb. 20, 1979

[54] SKI HAVING A PATTERNED TOP COVERING

[75] Inventor: Rudolf Ferch, Salzburg, Austria

[73] Assignee: Fischer Gesellschaft m.b.H., Ried im Innkreis, Austria

[21] Appl. No.: 839,258

[22] Filed: Oct. 4, 1977

[30] Foreign Application Priority Data

Oct. 4, 1976 [AT] Austria ..... 7357/76

[51] Int. Cl.[2] ..... A63C 11/14

[52] U.S. Cl. ..... 280/610; 428/256

[58] Field of Search ..... 280/604, 610, 602, 601, 280/11.37 E; 428/53, 54, 55, 56, 256

[56] References Cited

U.S. PATENT DOCUMENTS

| | | | |
|---|---|---|---|
| 3,731,449 | 5/1973 | Kephart | 428/256 X |
| 4,047,735 | 9/1977 | Ferch | 280/610 |

*Primary Examiner*—Joseph F. Peters, Jr.
*Assistant Examiner*—Gene A. Church
*Attorney, Agent, or Firm*—Imirie, Smiley & Guay

[57] ABSTRACT

A ski which has a tread and a patterned top covering consisting of a plurality of sheets of plastics material, which are colored throughout in different colors and arranged in succession in the longitudinal direction of the ski and adjoin at mating adjacent edges. Those portions of said sheets of plastics material which define said adjoining edges are held together in pairs by a grid on the underside of the sheets.

6 Claims, 2 Drawing Figures

SKI HAVING A PATTERNED TOP COVERING

SUMMARY OF THE INVENTION

Figure 1:
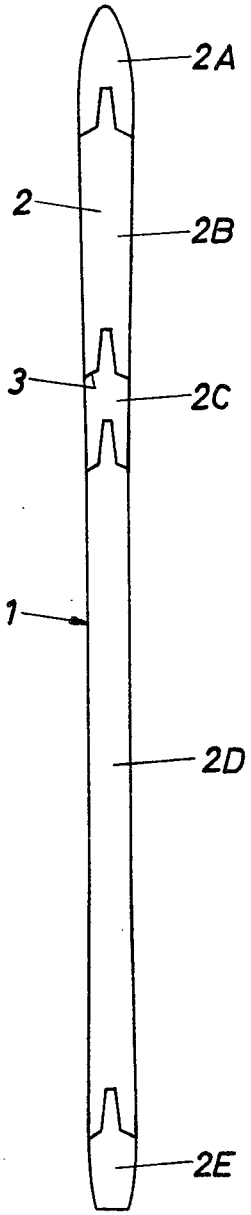

A ski has a top covering consisting of successive complementary sheets of plastics material, which are colored throughout in different colors and have adjacent edge portions which are held together on the underside by a grid which overlaps the edges.

BACKGROUND OF THE INVENTION

It is known to cover the top surface of the ski with a plurality of synthetic thermoplastic strips which are colored throughout in different colors. Extending in the longitudinal direction of the ski, these strips define parting lines which extend longitudinally of the ski. The crossing of the skis is the most frequent cause of a damage to the top surface of the skis because the steel edge of the upper ski scratches the surface of the lower ski from one longitudinal edge of the latter to the other transversely to the longitudinal direction of said lower ski. When this occurs with known skis having longitudinal strips, the steel edge of the upper ski when contacting the lower ski is at a small angle to the longitudinally extending joints between the covering strips so that individual strips may be torn from the ski. It has been attempted to eliminate this risk in that the strips were joined by welding although this welding of the strips involves an additional expenditure. Besides, the edge zones of the ski are particularly endangered and cannot be provided with the known longitudinal strips in the desired manner when the top surface of the ski is provided with a transversely extending pattern, as is presently customary.

In U.S. Pat. No. 4,047,735, the present inventor has proposed to provide a ski with a top covering which consists of a plurality of sheets of plastics material, which substantially abut each other at joints that extend transvesely to the longitudinal direction of the ski. The desired pattern is provided in that the sheets have different colors and are applied to the ski in close succession in the longitudinal direction thereof and adhesively joined to the underlying layer. These sections are stamped from different sheetings and each sheet is colored throughout in a uniform color. The strips are applied to the top surface of the ski in succession in a mosaic, similarly to intarsia, and are preferably adhesively joined to the top surface of the ski.

Skis of that kind consist usually of a plurality of layers, which comprise in most cases under the top covering a high-strength layer consisting of a plate of aluminum or steel or a glass fiber-reinforced laminate of plastics material.

It is an object of the invention to provide measures for effectively joining the top covering and the underlying part of the ski.

According to a feature of the invention, this object is accomplished in that a bond-improving liner is applied to the underside of the multi-sheet top covering before the latter is applied to the body of the ski or to that layer of the ski body to which the top covering is to be joined.

In accordance with another feature of the invention, the liner is applied only under the joints between the sheets.

According to a further feature of the invention, the liner consists of a mesh, e.g. of a net.

Metal mesh has proved to be particularly desirable as material for the liner. To apply that metal mesh, the sheets consisting preferably of ABS polymers (acrylonitrile-butadiene-styrene-plastics) are applied in the desired pattern on a support to contact the latter with their normally exposed side, and the mesh sections are applied to the joints between the sheets and are forced against them by means of a hot punch so that the sheets are fused in part and are thus bonded to the mesh. This operation results in welded joints between the sheets, which are bridged by the mesh. The resulting mosaic-like top covering can be durably joined, e.g. by adhesion, to the body of the ski or the uppermost layer of the body of the ski, and there is no risk that end portions or corners of individual covering sheets can separate even under the highest bending stresses which are to be expected.

Figure 2:
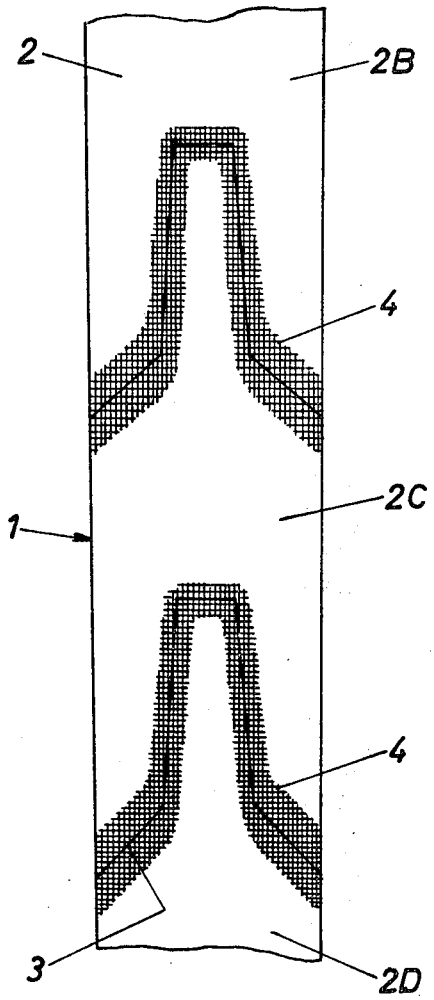

An embodiment of a ski provided with a top covering according to the invention is shown by way of example on the drawing, in which FIG. 1 is a top plan view showing the ski and FIG. 2 is an enlarged bottom view showing two sheets of the top covering.

The top covering is basically composed as in the embodiment described in U.S. Pat. No. 4,047,735, by the same inventor, and the same reference characters will subsequently be used for equal parts in order to facilitate a comparison.

The ski 1 has a top covering 2, which consists in the present case of five sheets 2A to 2E of plastics material, which have mating, interengaging edges and have been stamped from plate, strip or the like material and have a thickness of an order of 0.3 to 1.5 mm. The parting lines 3 between adjacent sheets may be identical or different. In the simplest case the parting lines are straight and extend at right angles or obliquely to the longitudinal direction of the ski. The parting lines have preferably such a configuration that adjoining sheets 2A to 2E of the top covering have mating, interengaging edge portions.

Mesh sections 4 extend over the sheets 2A to 2E at the edges thereof which adjoin the joints 3.

It will be understood that various modifications are possible within the scope of the invention. For instance, each mesh section need not cover the entire joint between adjacent covering sheets but only part of such joint.

Alternatively, the liner or mesh may cover the entire undersurface of the top covering. The liner may generally consist of any fine or coarse mesh, e.g. a braided mesh or a woven fabric or the like.

Within the scope of the invention, top coverings provided with the liner may be manufactured and may be used in the manufacture of new skis and for repairing skis having damaged top coverings, which are removed and replaced by top coverings provided with the liner.

The provision of the mesh liner affords three significant advantages:

(a) Good heat conduction;

(b) Strong welded joint;

(c) Resistance presented by the mesh to a flowing of the top covering sheets near the joints in the ski press.

What is claimed is:

1. In combination with a snow ski having a tread and a smooth upper surface, the improvement comprising a patterned top covering comprising a plurality of elongated sheets of plastic material, said plural sheets being colored throughout in different colors and arranged in succession longitudinally of said ski, adjacent sheets having mating edges such that said sheets are disposed in direct juxtaposition with each other throughout the length of the ski, a bond-improving liner means applied to at least protions of the undersurface of the top covering, and means for adhering said sheets and liner means to said upper surface of the ski, said liner means covering only the joint areas between the sheets.

2. A ski as set forth in claim 1, in which said sheets have a thickness of about 0.3 to 1.5 millimeters.

3. A ski as set forth in claim 1, in which the liner means comprises a mesh.

4. A ski as set forth in claim 1, in which the liner consists of metal threads.

5. A ski as set forth in claim 3, in which the mesh consists of a fine-mesh grid of metal.

6. A ski as set forth in claim 5, in which mesh is included in the welded joints between the sheets on the underside thereof.

* * * * *